US006414656B1

(12) United States Patent
Hong

(10) Patent No.: US 6,414,656 B1
(45) Date of Patent: Jul. 2, 2002

(54) PLASMA DISPLAY PANEL HAVING AUXILIARY ELECTRODE AND METHOD FOR DRIVING THE SAME

(75) Inventor: Byoung-hee Hong, Chunan (KR)

(73) Assignee: Samsung SDI Co., Ltd., Kyungki-Do (KR)

( * ) Notice: Subject to any disclaimer, the term of this patent is extended or adjusted under 35 U.S.C. 154(b) by 0 days.

(21) Appl. No.: 09/518,183

(22) Filed: Mar. 2, 2000

(30) Foreign Application Priority Data

Mar. 2, 1999 (KR) ..... 99-6728

(51) Int. Cl.[7] ..... G09G 3/28
(52) U.S. Cl. ..... 345/60; 313/581; 315/169.4
(58) Field of Search ..... 345/60, 62, 66, 345/67; 315/169.4; 313/581–586, 595, 596

(56) References Cited

U.S. PATENT DOCUMENTS 5,754,004 A * 5/1998 Miyagawa et al. ..... 313/585
5,952,782 A * 9/1999 Nanto et al. ..... 313/584
6,043,605 A * 3/2000 Park ..... 313/581
6,262,532 B1 * 7/2001 Park et al. ..... 315/169.4

FOREIGN PATENT DOCUMENTS

JP HEI 9-245627 9/1997

* cited by examiner

*Primary Examiner*—Regina Liang
(74) *Attorney, Agent, or Firm*—Lowe Hauptman Gilman & Berner, LLP

(57) ABSTRACT

A plasma display panel having an auxiliary electrode for lowering a discharge starting voltage between discharge sustain electrodes and a method for driving the same are provided. In the plasma display panel having the auxiliary electrode and the method for driving the same, a thin auxiliary electrode is arranged between an X electrode and a Y electrode arranged in each discharge cell of the plasma display panel and an electrode driving pulse is applied to the auxiliary electrode at the point in time which is not later than the point in time at which a discharge sustain pulse starts. Accordingly, the discharge starting voltage of the main discharge is reduced.

14 Claims, 6 Drawing Sheets t=0.5~3.0 μs t=3.0 μs

PLASMA DISPLAY PANEL HAVING AUXILIARY ELECTRODE AND METHOD FOR DRIVING THE SAME

BACKGROUND OF THE INVENTION

1. Field of the Invention

The present invention relates to a plasma display panel, and more particularly, to a plasma display panel having an auxiliary electrode for reducing a discharge starting voltage between discharge sustain electrodes and a method for driving the same.

2. Description of the Related Art

FIG. 1 shows the structure of electrodes of a conventional surface discharging type AC plasma display panel. As shown in FIG. 1, a data electrode 5 is arranged at a rear substrate 2. Discharge sustain electrodes comprised of a scanning electrode 3 (which may be referred to as a "Y electrode", hereinafter) and a common electrode 4 (which may be referred to as an "X" electrode, hereinafter) are arranged in parallel to cross the data electrode 5. A dielectric 7 is coated on the discharge sustain electrodes 3 and 4. The discharge sustain electrodes 3 and 4 are arranged in each discharge cell having a discharge space 9 provided by walls 6 (parts marked with dotted line are rotated by 90°) arranged in strips perpendicular to the discharge sustain electrodes 3 and 4. Bus electrodes 8 for improving the conductivity of the transparent electrodes 3 and 4 are formed on the discharge sustain electrodes, namely, the X electrode 4 and the Y electrode 3 to be arranged around the perimeter of the discharge space.

In the plasma display panel having the above structure, driving an electrode is roughly divided into driving for an address period and driving for a sustained discharge. As shown in FIG. 2, the address period is generated by an electric potential difference (80V−(−170V)=250V) between the data electrode 5 of the rear substrate 2 and the Y electrode 3 of a front substrate 1. At this time, a wall charge is formed. The sustained discharge is generated by an electric potential difference (140V−0V=140V) between the Y electrode 3 and the X electrode 4, arranged in the discharge cell in which the wall charge is formed. The sustained discharge for displaying a real image becomes a main discharge.

The main discharge generated by the electric potential difference applied between the X electrode 4 and the Y electrode 3, become decreased as time passes, as shown in FIG. 3. This is because the discharge starting voltage for the sustained discharge driving should be generally no less than 160V since the distance between the X electrode 4 and the Y electrode 3 of the front substrate is about 80–100 $\mu$m in the electrode structure of the conventional surface discharging type AC plasma display panel. When the discharge starting voltage becomes large, consumption of electric power increases and the rating of a driving circuit becomes larger, thus costing much. Also, an induced voltage is generated in an adjacent electrode, thus causing crosswalk. When the distance between the X electrode 4 and the Y electrode 3 is narrowed in order to reduce the discharge starting voltage, an electrostatic capacity becomes too large. Namely, the discharge starting voltage is lowered as the distance d between two electrodes becomes shorter. However, it has a restriction on lowering the distance d because of an undesirable increase in the electrostatic capacity. It is very important to driving the plasma display panel to reduce the discharge starting voltage without increasing the electrostatic capacity which are parasitic between the two electrodes.

SUMMARY OF THE INVENTION

To solve the above problem, it is an objective of the present invention to provide a plasma display panel in which it is possible to remarkably reduce a discharge starting voltage by arranging a thin auxiliary electrode between an X electrode and a Y electrode, maintaining the two electrodes as they are and a method for driving the plasma display panel.

Accordingly, to achieve the above objective, there is provided a surface discharge type AC plasma display panel, comprising a front substrate and a rear substrate which face each other with a predetermined distance, walls for maintaining a distance between the front substrate and the rear substrate and providing discharge spaces, pairs of discharge sustain electrodes arranged in strips on a surface of the front substrate to be parallel with each other, and data electrodes arranged on a surface of the rear substrate in strips perpendicular to the pairs of discharge sustain electrodes, wherein an auxiliary electrode of a predetermined thickness is arranged between each pair of discharge sustain electrodes.

The thickness of the auxiliary electrode is preferably such that it does not increase the electrostatic capacity of the pairs of discharge sustain electrodes.

To achieve the above objective, there is provided a method for driving a plasma display panel comprising a front substrate and a rear substrate which face each other with a predetermined distance, walls for maintaining a distance between the front substrate and the rear substrate and providing discharge spaces, pairs of discharge sustain electrodes arranged in strips on a surface of the front substrate to be parallel with each other, and data electrodes arranged on a surface of the rear substrate in strips perpendicular to the pairs of discharge sustain electrodes, wherein an auxiliary electrode of a predetermined thickness is arranged between each pair of discharge sustain electrodes, comprising the step of applying an auxiliary electrode driving pulse to the auxiliary electrode earlier than the point in time at which the discharge sustain pulses are applied to the discharge sustain electrode pairs.

In the present invention, the auxiliary electrode driving pulse preferably makes the electric potential of an auxiliary electrode equal to the electric potential of an electrode having a higher electric potential among the pair of discharge sustain electrodes when the discharge sustain pulse is applied to the pairs of discharge sustain electrodes and the discharge becomes larger and preferably maintains the electric potential of the auxiliary electrode to be equal to the electric potential of an electrode having a lower electric potential when the discharge is decreased.

In the present invention, the auxiliary electrode driving pulse preferably makes the electric potential of an auxiliary electrode equal to the electric potential of an electrode having a lower electric potential among the pair of discharge sustain electrodes when the discharge sustain pulse is applied to the pairs of discharge sustain electrodes and the discharge becomes larger and preferably maintains the electric potential of the auxiliary electrode to be equal to the electric potential of an electrode having a higher electric potential when the discharge is decreased.

BRIEF DESCRIPTION OF THE DRAWING(S)

The above objective and advantages of the present invention will become more apparent by describing in detail a preferred embodiment thereof with reference to the attached drawings in which.

DESCRIPTION OF THE PREFERRED EMBODIMENTS

Hereinafter, a plasma display panel having an auxiliary electrode according to the present invention and a method for driving the same will be described in detail with reference to the attached drawings.

Figure 1:
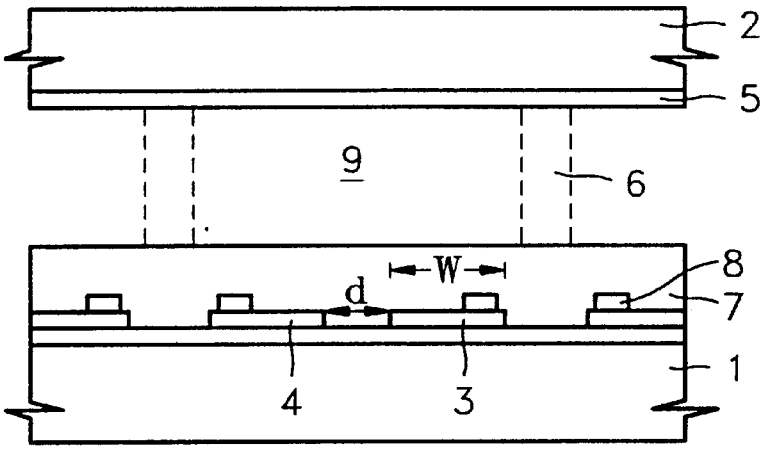
FIG. 1 (PRIOR ART)
FIG. 1 is a sectional view showing the structure of a conventional plasma display panel.
Figure 2:
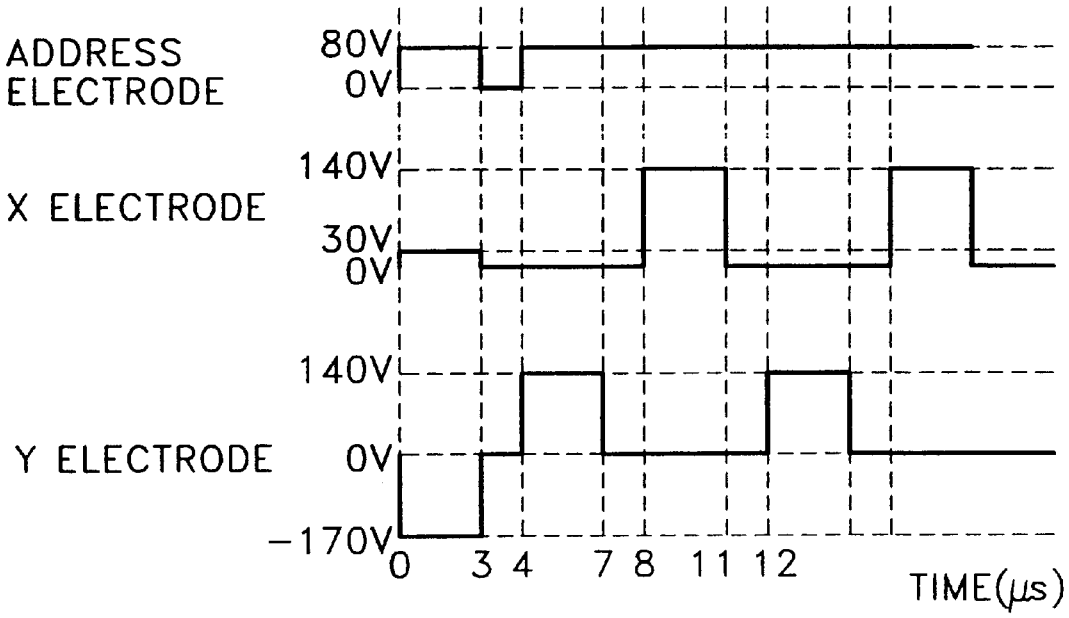
FIG. 2 shows waveforms of electrode driving signals applied to the plasma display panel of FIG. 1.
Figure 3:
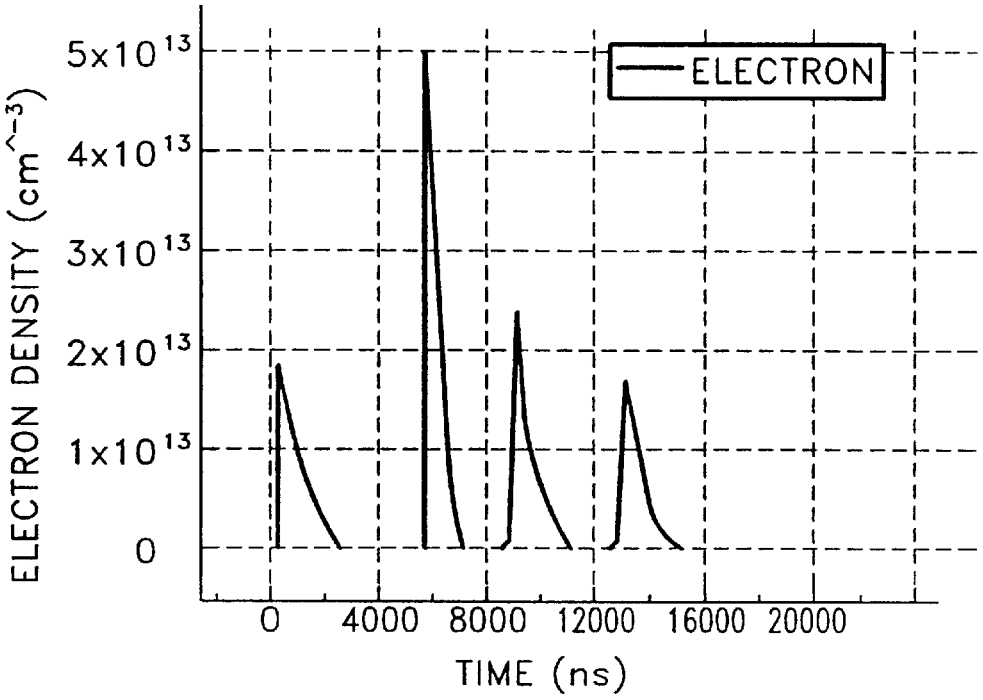
FIG. 3 is a graph showing the density of electrons generated in a discharge space by the electrode driving signal of FIG. 2.
Figure 4:
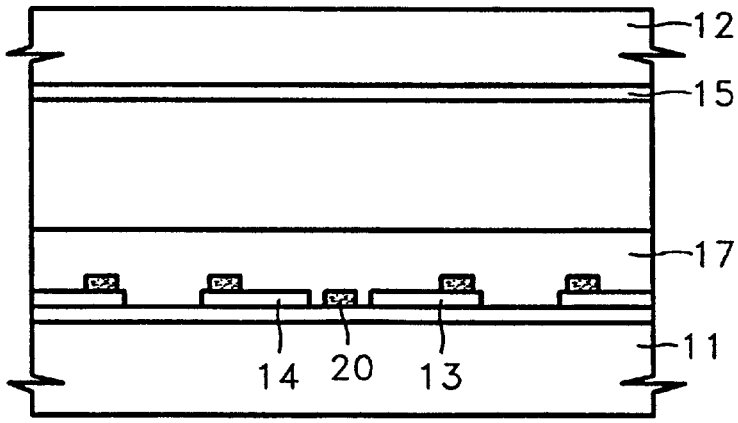
FIG. 4 is a sectional view showing the structure of an electrode of a plasma display panel according to the present invention.

FIG. 4 is a cross view showing the structure of a plasma display panel having an auxiliary electrode according to the present invention. A thin auxiliary electrode 20 is installed between discharge sustain electrodes, i.e., an X electrode 14 and a Y electrode 13 arranged on a front substrate 11. Here, it is preferable that the increase in electrostatic capacity due to the auxiliary electrode 20 is minimal. For this, the auxiliary electrode should be thin.

Such an auxiliary electrode is designed in order to facilitate the initial discharge. In order to perform this well, accumulation of wall charges should be controlled advantageously to start the discharge. Namely, the auxiliary electrode 20 (electrode C) should be driven so that the wall charges are accumulated on the upper surface of a dielectric layer 17 to assist in the discharge. For this, the driving pulse of the auxiliary electrode (the electrode C) should be synchronized to the driving pulse applied to the X electrode or the Y electrode, having a pulse width of 0.5 $\mu$s as shown in FIG. 5.

Figure 5:
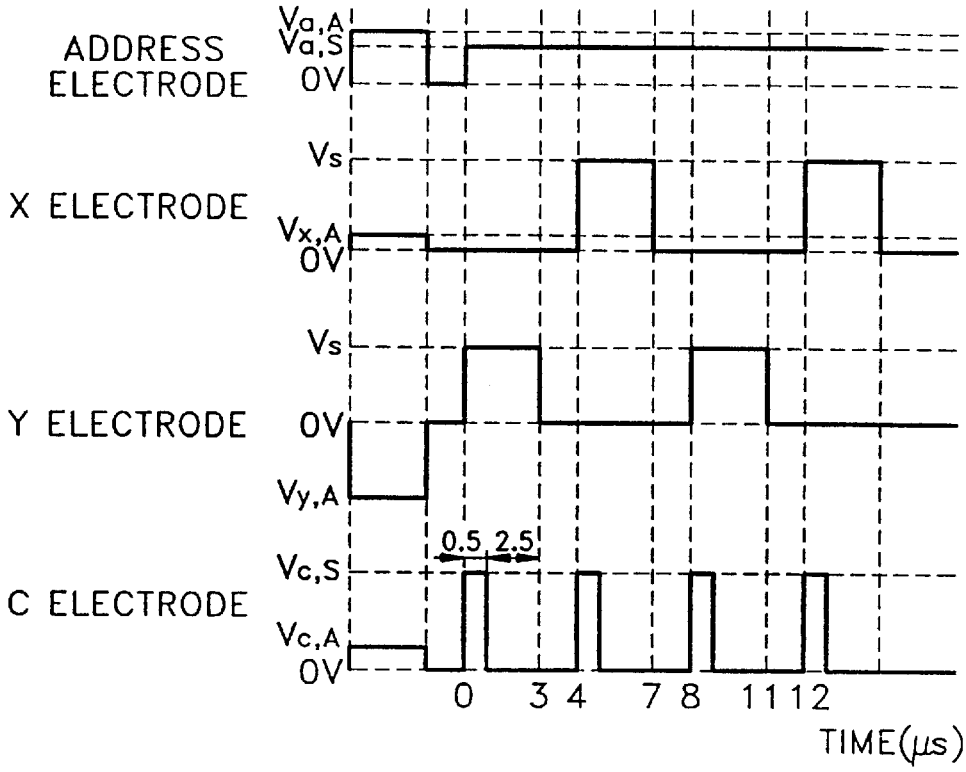
FIG. 5 shows waveforms of electrode driving signals applied to the plasma display panel of FIG. 4.

For example, when the period of an auxiliary electrode driving pulse is made to coincide with the period of a composite pulse of discharge sustain electrode driving pulses (difference between X pulse and Y pulse) and the leading edge of an auxiliary pulse coincides with the leading edges of X and Y pulses as shown in FIG. 5, it is noted that the discharge is sustained well although time passes although the voltage of the discharge sustain pulse is lowered from 160V to 140V.

The principle of maintaining the discharge well even with the passing of time is as follows.

In general, a period during which the discharge is sustained is about 1 $\mu$m in the surface discharging type AC plasma display panel. In this period, the discharge increases during the first 0.5 $\mu$s and the discharge is decreased during the second 0.5 $\mu$s. In the period 1us during which the discharge is sustained, the auxiliary electrode operates as the electrode of a positive electric potential (or a negative electric potential) during the first 0.5 $\mu$s and as the electrode of the negative electric potential (or the positive potential) during the second 0.5 $\mu$s. Accordingly, the wall charges are more easily accumulated. FIGS. 7A through 7E show the distribution of wall charges in the discharge cell during the sustained discharge driving period.

Figure 7A:
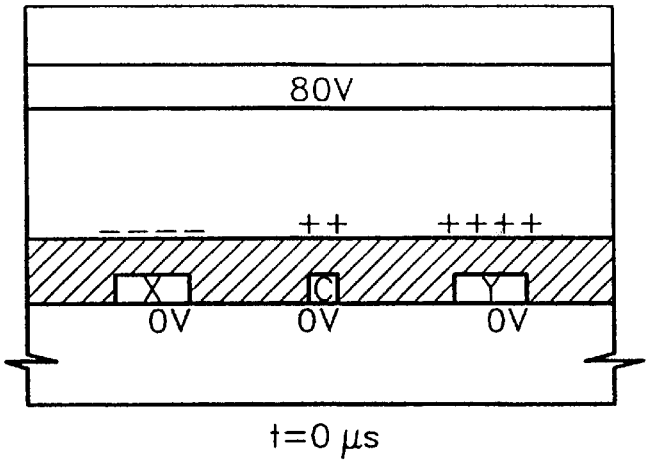
FIGS. 7A through 7E show distribution states of wall charges formed in a discharge cell by the electrode driving signals of FIG. 5.
Figure 7B:
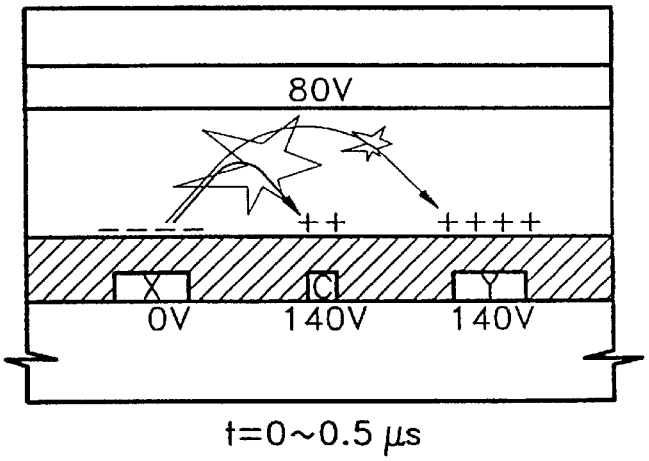
Figure 7C:
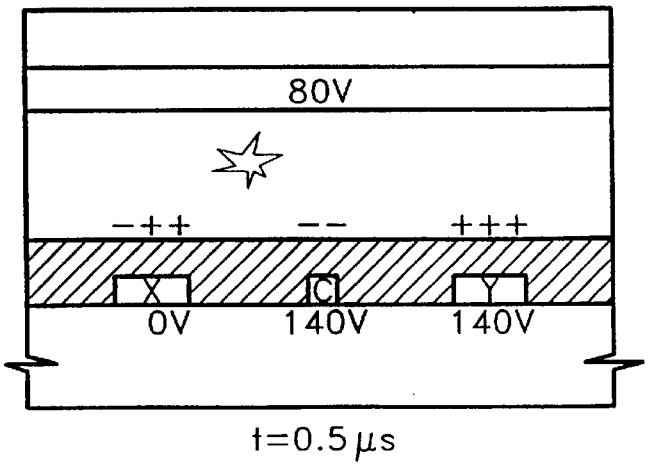
Figure 7D:
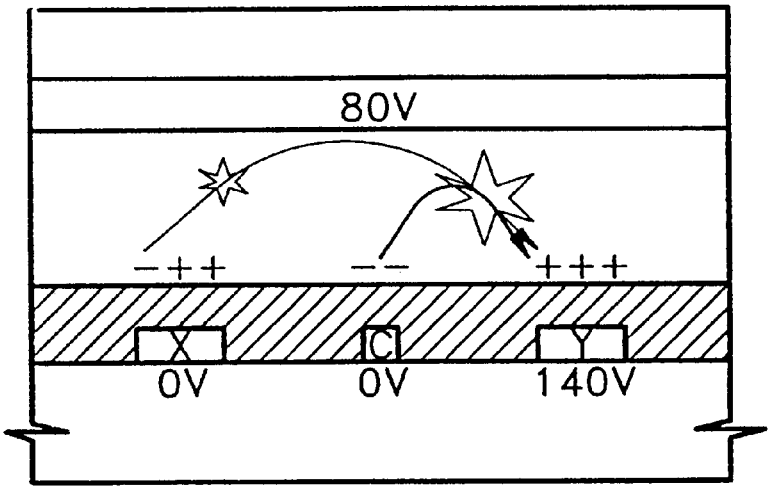
Figure 7E:
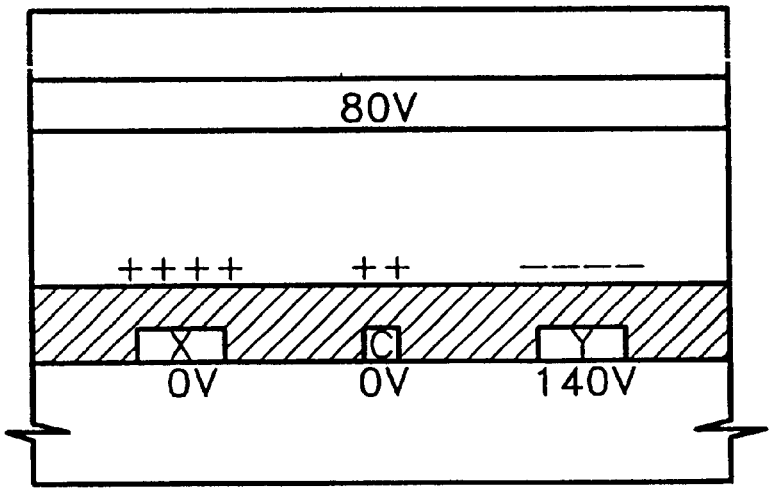

The distribution of wall charges formed in the discharge cell during the periods of 0 $\mu$s, 0–0.5 $\mu$s, 0.5 $\mu$s, and 3 $\mu$s in FIG. 5 is shown. What is important here is that the polarity of the wall charge is changed at the rising edge of auxiliary pulse so that the discharge is easily generated as shown in FIGS. 7B and 7C. In FIGS. 7A through 7E, arrows denote the movement paths of electrons. Thick solid line arrows denote states of the discharges which first occur. Thin solid line arrows denote states of the discharges which occur later. Therefore, the state displayed in FIG. 7C occurs for an extremely short period of time. Also, since the discharge sustain pulse and the auxiliary electrode driving pulse are periodic, the distribution state of the wall charges by the discharge is continuously repeated in the order of →FIG. 7A→FIG. 7B→FIG. 7C→FIG. 7D→FIG. 7E→ and in the same order, in which the negative and the positive are switched. Namely, after the process of FIG. 7A→FIG. 7B→FIG. 7C→FIG. 7D→FIG. 7E→ proceeds, the same discharge process is repeated with the polarity of the accumulated wall charges is interchanged. Also, it is preferable that the auxiliary driving pulse has a rising edge first and a falling edge later. Otherwise, the discharge is not sustained. This is because the electric potential condition of the address pulse. When the electric potential condition of the address pulse is reversed, the opposite result will be obtained.

Figure 6:
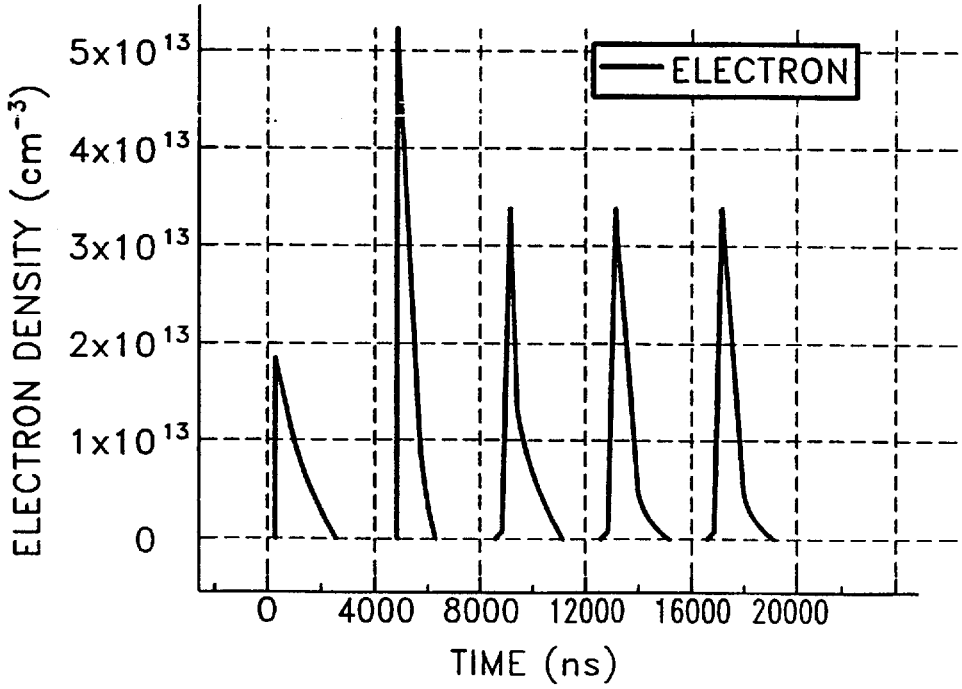
FIG. 6 is a graph showing the density of electrons generated in a discharge space by the electrode driving signal of FIG. 5.
Figure 8:
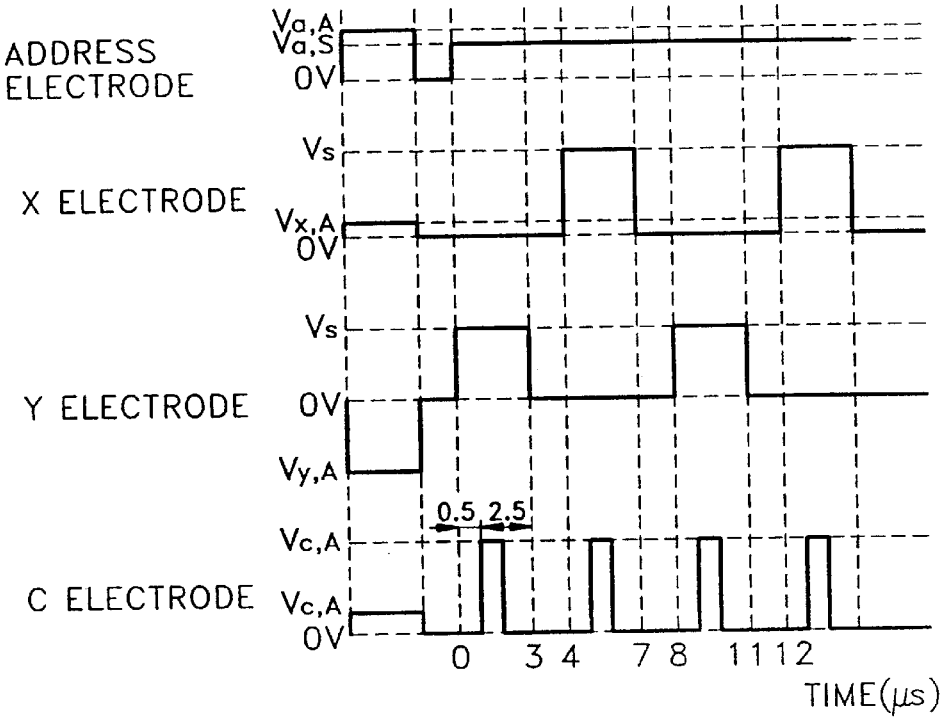
FIG. 8 shows waveforms of electrode driving signals applied to the plasma display panel of FIG. 4, in which an auxiliary electrode driving signal is incorrectly applied.
Figure 9:
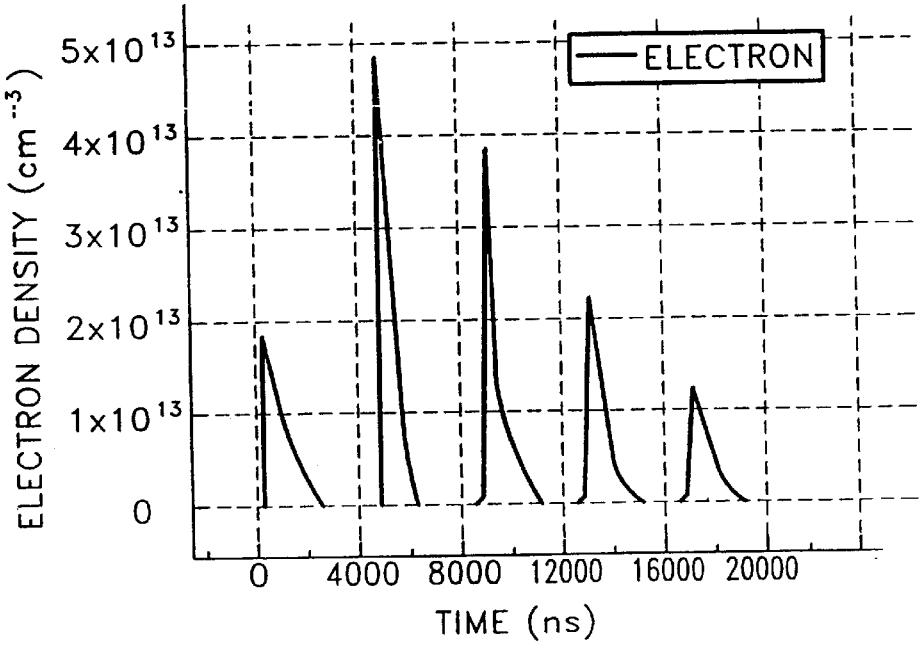
FIG. 9 shows the density of electrons generated in a discharge space by the electrode driving signal of FIG. 8.

Also, what is important here is that the rising edge of the auxiliary pulse should not occur after the leading edge of sustain pulses. Otherwise, the auxiliary electrode driving pulse does not significantly help the mail discharge between the X electrode and the Y electrode. Therefore, it is not possible to reduce the voltage of the discharge sustain pulse for generating the main discharge, which is shown by the experiment results of FIGS. 8 and 9. Namely, the auxiliary electrode driving pulse is applied to the auxiliary (c) electrode in the later part of the discharge sustain pulse period as shown in FIG. 8, and the discharge is gradually decreased as time passes as shown in FIG. 9 in contrast with FIG. 6.

As mentioned above, in the plasma display panel having the auxiliary electrode according to the present invention and the method for driving the same, a thin auxiliary electrode is arranged between the X electrode and the Y electrode arranged in each discharge cell of the plasma display panel and the auxiliary electrode driving pulse is applied to the auxiliary electrode at the point in time which is not later than the point in time at which the discharge sustain pulse starts. Accordingly, it is possible to reduce the discharge starting voltage of the main discharge to 20V. Also, the brightness is improved since it is possible to make the discharge sustaining time long in the defined discharge sustain pulse period.

What is claimed is:

1. A surface discharge type AC plasma display panel, comprising:

a front substrate and a rear substrate facing each other and spaced by a predetermined distance;

a plurality of pairs of parallel discharge sustaining electrodes arranged on a surface of the front substrate;

a plurality of data electrodes arranged on a surface of the rear substrate transversely to the discharge sustaining electrodes, each of said data electrodes defining together with one of said pairs of the discharge sustaining electrodes a discharge cell; and an auxiliary electrode of a predetermined thickness arranged between the discharge sustaining electrodes within each said discharge cell.

2. The plasma display panel of claim 1, wherein the thickness of the auxiliary electrode is such that the presence of the auxiliary electrode does not increase the electrostatic capacity of the respective pair of the discharge sustaining electrode.

3. The plasma display panel of claim 1, further comprising walls for maintaining the distance between the front substrate and the rear substrate.

4. A method for driving a plasma display panel comprising a front substrate and a rear substrate facing each other and spaced by a predetermined distance, a plurality of pairs of first and second parallel discharge sustaining electrodes arranged on a surface of the front substrate, a plurality of data electrodes arranged on a surface of the rear substrate transversely to the first and second discharge sustaining electrodes, and an auxiliary electrode of a predetermined thickness arranged between each of said pairs of the first and second discharge sustaining electrodes, said method comprising, in a discharge sustaining period, the steps of:

applying at least one discharge sustaining pulse to at least one of said pairs of the first and second discharge sustaining electrodes so as to sustain a discharge therebetween, and applying at least one auxiliary electrode driving pulse, corresponding to said at least one discharge sustaining pulse, to the auxiliary electrode arranged between the first and second discharge sustaining electrodes of said at least one pair;

wherein said auxiliary electrode driving pulse has a leading edge occurring no later than a leading edge of said discharge sustaining pulse, and a trailing edge occurring prior to a trailing edge of said discharge sustaining pulse.

5. The method of claim 4, wherein while said discharge sustaining pulse is being applied to the first and second discharge sustaining electrodes of said at least one pair to sustain the discharge, said auxiliary electrode driving pulse makes an electric potential of the auxiliary electrode equal to an electric potential of the first discharge sustaining electrode of said at least one pair when the discharge is increased, and maintains the electric potential of the auxiliary electrode to be equal to an electric potential of the second discharge sustaining electrode of said at least one pair when the discharge is decreased.

6. The method of claim 5, wherein the electric potential of the first discharge sustaining electrode of said at least one pair is higher than the electric potential of the second discharge sustaining electrode of said at least one pair.

7. The method of claim 5, wherein the electric potential of the first discharge sustaining electrode of said at least one pair is lower than the electric potential of the second discharge sustaining electrode of said at least one pair.

8. The plasma display panel of claim 4, wherein the leading edge of said auxiliary electrode driving pulse coincides with the leading edge of said discharge sustaining pulse.

9. The method of claim 4, wherein said auxiliary electrode driving pulse has a pulse width shorter than that of said discharge sustaining pulse.

10. The method of claim 9, wherein the pulse width of said auxiliary electrode driving pulse is less than a half of the pulse width of said discharge sustaining pulse.

11. The method of claim 4, wherein said at least one discharge sustaining pulse comprises a series of discharge sustaining pulses, and said at least one auxiliary electrode driving pulse comprises a plurality of auxiliary electrode driving pulses each corresponding to one of the discharge sustaining pulses.

12. The method of claim 11, wherein a polarity of the discharge sustaining pulses alternates while a polarity of the auxiliary electrode driving pulses remains unchanged.

13. A method of driving a plasma display panel comprising front and rear substrates facing and spaced from each other, at least one pairs of first and second electrodes arranged on one of the substrates, and an auxiliary electrode arranged between the first and second electrodes, said method comprising the steps of:

causing first and second wall charges of opposing polarities to accumulate in the vicinity of the first and second electrodes, respectively; and applying at least one discharge sustaining pulse to the first and second electrodes so as to cause a discharge to occur between the first and second wall charges of the first and second electrodes, respectively;

said method further comprising the step of applying at least one auxiliary-electrode driving pulse, corresponding to said at least one discharge sustaining pulse, to the auxiliary electrode arranged between the first and second electrodes so as to cause an auxiliary discharge to occur between the auxiliary electrode and the first electrode prior to the discharge between the first and second electrodes.

14. The method of claim 13, wherein said auxiliary electrode driving pulse causes an auxiliary wall charge to accumulate in the vicinity of the auxiliary electrode, the auxiliary wall charge having a polarity opposite to that of the first wall charge.

* * * * *